United States Patent [19]

Sokol et al.

[11] Patent Number: 4,896,382

[45] Date of Patent: Jan. 30, 1990

[54] AUTOMATIC TOILET BOWL CLEANER WITH A METERED DISPENSING OF CLEANING COMPOSITION

[75] Inventors: John E. Sokol, Spring Lake Heights; Peter J. Mackinson, Basking Ridge, both of N.J.

[73] Assignee: Block Drug Company, Inc., Jersey City, N.J.

[21] Appl. No.: 279,919

[22] Filed: Dec. 5, 1988

[51] Int. Cl.[4] ..... E03D 9/02

[52] U.S. Cl. ..... 4/228; 4/222

[58] Field of Search ..... 4/227, 228, 222; 422/266

[56] References Cited

U.S. PATENT DOCUMENTS

| | | | |
|---|---|---|---|
| 685,020 | 10/1901 | Venners | 221/57 |
| 3,341,074 | 9/1967 | Pannutti | 220/31 |
| 3,831,205 | 8/1974 | Foley | 4/228 |
| 4,530,118 | 7/1985 | Richards | 4/228 |
| 4,534,071 | 8/1985 | Russomanno | 4/227 |

FOREIGN PATENT DOCUMENTS

| | | | |
|---|---|---|---|
| 26284 | 12/1898 | United Kingdom | 4/228 |

*Primary Examiner*—Linda J. Sholl

*Attorney, Agent, or Firm*—Ostrolenk, Faber, Gerb & Soffen

[57] ABSTRACT

An automatic bottom-of-the-tank toilet bowl cleaner device which dispenses a metered amount of cleaning solution into a toilet bowl after each flush. The device has a reservoir which contains concentrated cleaning solution. The reservoir has a vent which is ordinarily closed off by a flotation unit, thus preventing the cleaning solution from being released into the tank. When the toilet is flushed, the water level in the tank drops, thereby lowering the flotation unit, allowing air to enter the reservoir through the vent, and releasing a measured quantity of cleaning solution into the toilet tank.

7 Claims, 3 Drawing Sheets

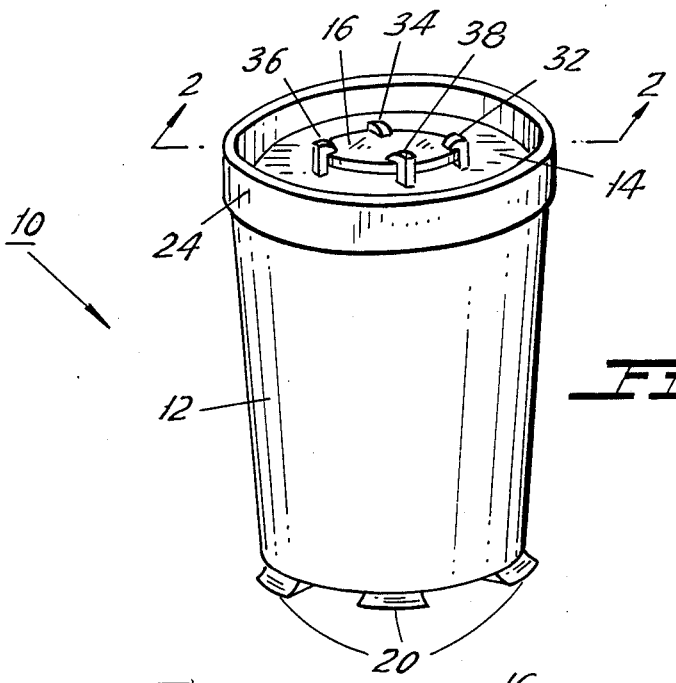
FIG. 1.
FIG. 2.
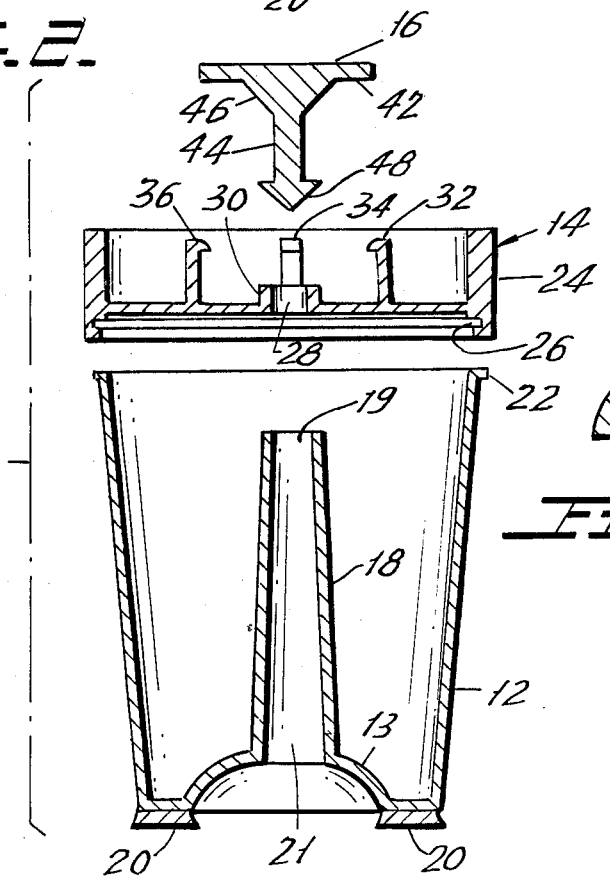
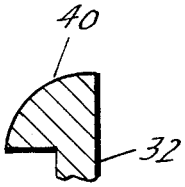
FIG. 3.

AUTOMATIC TOILET BOWL CLEANER WITH A METERED DISPENSING OF CLEANING COMPOSITION

BACKGROUND OF THE INVENTION

1. Field of the Invention

The present invention relates to a toilet bowl cleaning device and, more particularly, to a bottom-of-the-tank toilet bowl cleaning device which releases a metered quantity of cleaning composition each time the toilet is flushed.

2. Description of the Related Art

Known toilet bowl cleaning devices fall into two broad categories. In the first category are devices which are secured to the side of the toilet tank. These devices release a regulated amount of cleaning composition, but require precise adjustment to work properly.

In the second category are toilet bowl cleaning devices which sit at the bottom of the toilet tank. These devices constantly release cleaning composition into the tank water, resulting in inefficient product usage. Furthermore, the concentration of the cleaning composition released into the toilet bowl will vary, creating an inconsistent product effect.

Other problems are associated with prior art toilet bowl cleaning devices. For example, the types of devices described above are subject to leakage of cleaning composition prior to use.

SUMMARY OF THE INVENTION

Accordingly, one object of the present invention is to provide a bottom-of-the-tank toilet bowl cleaning device with a metered dispensing mechanism which overcomes the problems of the above-described prior art devices.

A further object of the invention is to provide a device which can be stored without leakage prior to use.

The foregoing and other objects are achieved by providing an automatic bottom-of-the-tank toilet bowl cleaner device which dispenses a metered amount of cleaning solution into a toilet bowl after each flush. The device has a reservoir which contains concentrated cleaning solution. The reservoir has a vent which is ordinarily closed off by a flotation unit, thus preventing the cleaning solution from being released into the tank. When the toilet is flushed, the water level in the tank drops, thereby lowering the flotation unit, allowing air to enter the reservoir through the vent, and releasing a measured quantity of cleaning solution into the toilet tank.

BRIEF DESCRIPTION OF THE DRAWINGS

FIG. 1 illustrates a plan view of the toilet bowl cleaning device of the present invention.

FIG. 2 illustrates an exploded, cross-sectional view of the toilet bowl cleaning device of the present invention along lines 2—2 of FIG. 1.

FIG. 3 illustrates a magnification of a portion of the cover of the toilet bowl cleaning device of the present invention.

DETAILED DESCRIPTION OF THE PREFERRED EMBODIMENT

Figure 4:
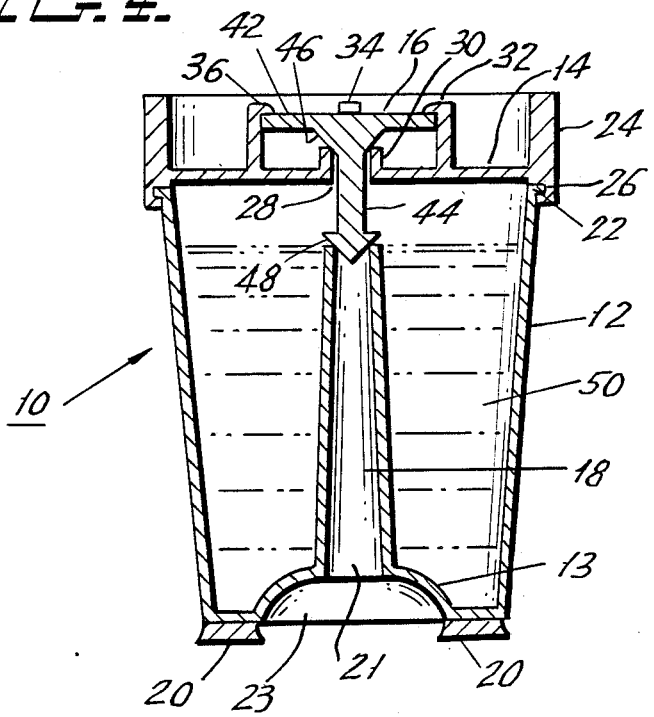
FIG. 4 illustrates a cross-sectional view along lines 2—2 of FIG. 1 with the toilet bowl cleaning device in its storage position.

Referring first to FIGS. 1–3, the toilet bowl cleaning device of the present invention is indicated generally by reference numeral 10. The primary components of device 10 are a cleaning composition container 12, and a cover 14 provided with a float 16. Float 16 interacts with cover 14 and container 12 to release a metered amount of a cleaning composition/water mixture from container 12.

Container 12 is generally cylindrical, tapering inward from top to bottom. The top of container 12 is open and has a lip 22 along its periphery. A plurality feet 20 support the bottom portion 13 of container 12.

Container 12 is provided with a central tube 18. Tube 18 has an upper opening 19 which opens into the upper interior of container 12, and a lower opening 21 which opens to the exterior of container 12 through an aperture in the bottom portion 13 of container 12. Tube 18 is preferably tapered inward at the upper opening 19. Cleaning composition is held in the annular space between tube 18 and container 12

Container lip 22 forms one piece of an interlocking fastener arrangement with cover 14. Cover 14 is a generally flat circular member bounded circumferentially by an upstanding wall 24. Wall 24 is provided with a groove 26 on its inside face, below the main flat body of cover 14. Groove 26 receives container lip 22 in an interlocking arrangement so that cover 14 is securely mounted upon container 12.

Cover 14 is also provided with a vent aperture 28 centrally located so as to align with tube 18 of container 12. Vent aperture 28 is bounded by a tubular member 30 which extends upward from the top surface of cover 14. A number of posts 32, 34, 36, 38 also extend upward from the top surface of cover 14 Each post terminates upwardly with a tab 40 (better seen in FIG. 3) which extends laterally inward toward the center of cover 14. The tabs are used to secure float 16 during storage, as discussed below.

Float 16 interacts with vent aperture 28 of cover 14 to release a metered amount of cleaning solution from container 12. Float 16 has a central shaft 44 which extends downward from the bottom surface of a disk-shaped top 42. Shaft 44 is slidably received in vent aperture tube 30. Shaft 44 carries on its upper end a frustoconical shaped upper plug 46 and on its lower end a conical shaped lower plug 48.

Having described the structure of device 10, its operation will now be described in connection with FIGS. 4–6. Prior to use, device 10 is stored in the position illustrated in FIG. 4 to avoid leakage of cleaning composition. To place the device in this storage position, disk top 42 of float 16 is manually depressed below tabs 40 of posts 32, 34, 36, 38. In the storage position, upper plug 46 is received in vent aperture tube 30 and closes vent aperture 28, while lower plug 48 is received in upper opening 19 of tube 18 and closes tube 18. Accordingly, device 10 is closed to the atmosphere and, at the same time, container 12 is sealed with cleaning composition 50 contained therein. Device 10 can thus be shipped and stored in this position without leakage.

When device 10 is to be used, float 16 is released from its storage position below tabs 40 of posts 32, 34, 36, 38.

Device 10 is then placed in the bottom of the toilet tank filled with water. The buoyant forces from the water in the toilet tank cause float 16 to rise to the position shown in FIG. 5, where the level of the water line is indicated by reference numeral 54. In this position, the lower plug 48 of float 16 is raised into contact with cover 14 and closes vent aperture 28, thus preventing cleaning composition from exiting device 10. However, since tube 18 is open at top and bottom cleaning composition 50 will mix with water from the toilet tank and form a cleaning composition and water mixture 52 above opening 19 of tube 18. The volume of cleaning composition and water mixture 52 depends on the amount of space in container 12 above opening 19. Thus, if a larger mixture quantity is desired, tube 18 can be made shorter, thus increasing the volume between tube 18 and cover 14 in container 12. Accordingly, a predetermined quantity of cleaning composition/water mixture is produced by device 10.

The next operational stage of device 10 corresponds to when the toilet is flushed and water level 54 in the toilet tank recedes. In this stage, illustrated in FIG. 6, the float 16 is released as the water level and its buoyant forces recede, such that float 16 settles onto the top of the tabs 40 of posts 32, 34, 36, 38. Air (shown by the broken dashed line arrows) rushes under disk top 42 through the space between the posts 32, 34, 36, 38 and flows through the vent aperture tube 30 and into the upper area of container 12 occupied by the cleaning composition and water mixture 52. Mixture 52 is displaced from container 12 by the air and flows downward out of container 12 through tube 18, exiting tube 18 at lower tube opening 21 (as shown by the solid line arrows). Mixture 52 collects in recess region 23 disposed outside the bottom 13 of container 12 and disperses outward between feet 20 into the water of the toilet tank.

Figure 5:
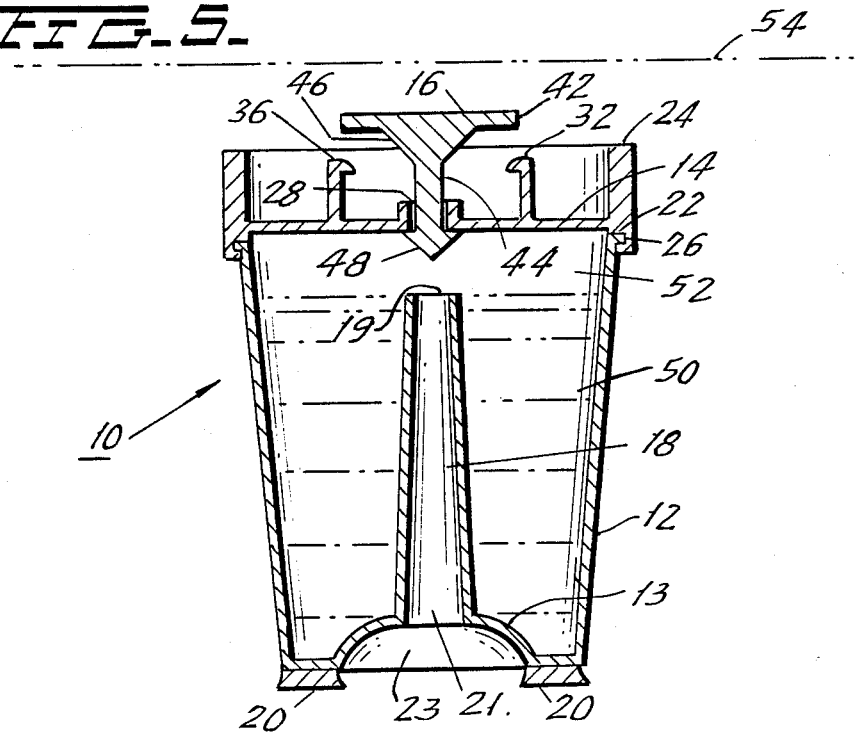
FIG. 5 illustrates a cross-sectional view along lines 2—2 of FIG. 1, with the toilet bowl cleaning device in use between flushes of the toilet.
Figure 6:
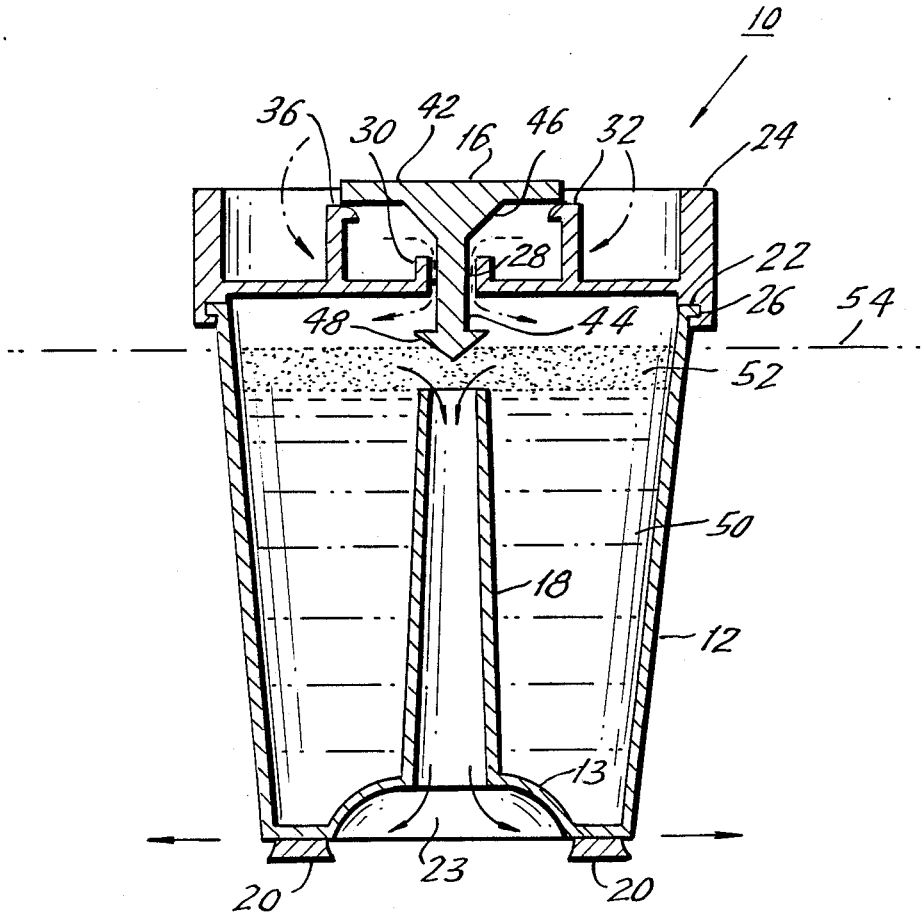
FIG. 6 illustrates a cross-sectional view along lines 2—2 of FIG. 1 of the toilet bowl cleaning device in use when the toilet is flushed.

When the toilet is between flushes (as shown in FIG. 5), vent aperture 28 is closed by lower plug 48 of float 16. Thus, cleaning composition and water mixture 52 is not displaced from container 12 because no air can enter container 12. Moreover, because the cleaning composition 50 is more buoyant than water (as discussed below), it does not diffuse down through tube 18 to any appreciable degree. Cleaning composition is also trapped upwardly in container 12 by cover 14, and cannot escape through vent aperture 28 because it is closed off by lower plug 48. However, when the water level 54 in the toilet tank recedes and float 16 falls onto the top of tabs 40, a metered amount or shot-size of cleaning composition and water mixture 52 is displaced by air and released into the toilet tank via tube 18.

Device 10 is preferably used with solid, semi-solid, or liquid cleaning compositions. These compositions may contain active ingredients such as chlorine, bromine, dyes, surfactants, acids, alkalies, germicides, bactericides, chelants, fragrances and other solvents and water softening agents suitable for toilet bowl cleaning. Container 12, cover 14, and float 16 are preferably formed of plastic, although any suitable substitute material could be utilized. Float 16 must be a plastic or other material having a lower density than water so it will float.

Although the present invention has been described in connection with a preferred embodiment thereof, many other variations and modifications will now become apparent to those skilled in the art without departing from the scope of the invention. It is preferred, therefore, that the present invention not be limited by the specific disclosure herein, but only by the appended claims.

What is claimed is:

1. A bottom-of-the-tank toilet bowl cleaning device, comprising:

a container for holding cleaning composition, said container having a substantially vertically oriented tube for dispensing said cleaning composition;

a cover which fits over said container, said cover having a vent aperture; and, a float which cooperates with said tube of said container and said vent aperture of said cover, said float being disposed in a first position in which it closes both said vent aperture and tube for storage of said device, said float being movable when said device is in use between a second position in which it closes said vent aperture and prevents air from entering said container, and a third position in which said float opens said vent aperture to allow air to enter said container and displace a mixture of cleaning composition and water above said tube, thereby dispensing said mixture of water and cleaning composition through said tube into the toilet tank.

2. A device as claimed in claim 1, wherein the float comprises a downwardly oriented shaft which is slidably received in said vent aperture, said shaft being provided at its upper end with an upper plug which closes said vent aperture during storage and at its lower end with a lower plug which closes said tube during storage.

3. A device as claimed in claim 2, wherein said float further comprises a disk top which is lockable during storage under lateral tabs of a plurality of upstanding posts on said cover.

4. A device as claimed in claim 1, wherein said container has a lip disposed circumferentially along its upper periphery, said lip being received in a corresponding circumferential groove in said cover to fasten said cover to said container.

5. A device as claimed in claim 2, wherein said upper plug has a frustoconical shape, and the lower plug has a conical shape.

6. A device as claimed in claim 1, wherein said tube and said vent aperture are substantially centrally located within the container.

7. A device as claimed in claim 1, wherein the container includes a plurality of feet which rest on the bottom of the toilet tank when said device is in use.

* * * * *